US009793589B2

(12) United States Patent
Kai

(10) Patent No.: US 9,793,589 B2
(45) Date of Patent: Oct. 17, 2017

(54) BAND-PASS FILTER COMPRISED OF A DIELECTRIC SUBSTRATE HAVING A PAIR OF CONDUCTIVE LAYERS CONNECTED BY SIDEWALL THROUGH HOLES AND CENTER THROUGH HOLES

(71) Applicant: NEC Corporation, Tokyo (JP)

(72) Inventor: Takafumi Kai, Tokyo (JP)

(73) Assignee: NEC Corporation, Tokyo (JP)

( * ) Notice: Subject to any disclaimer, the term of this patent is extended or adjusted under 35 U.S.C. 154(b) by 68 days.

(21) Appl. No.: 14/401,613

(22) PCT Filed: Apr. 1, 2013

(86) PCT No.: PCT/JP2013/060876
§ 371 (c)(1),
(2) Date: Nov. 17, 2014

(87) PCT Pub. No.: WO2013/183354
PCT Pub. Date: Dec. 12, 2013

(65) Prior Publication Data

US 2015/0137911 A1 May 21, 2015

(30) Foreign Application Priority Data

Jun. 4, 2012 (JP) ..... 2012-127061

(51) Int. Cl.
*H01P 1/208* (2006.01)
*H01P 1/20* (2006.01)
(Continued)

(52) U.S. Cl.
CPC ..... *H01P 1/2088* (2013.01); *H01P 1/2002* (2013.01); *H01P 1/207* (2013.01); *H01P 3/121* (2013.01)

(58) Field of Classification Search
CPC .... H01P 1/2002; H01P 1/2084; H01P 1/2088; H01P 7/10
(Continued)

(56) References Cited

U.S. PATENT DOCUMENTS 6,057,747 A 5/2000 Takenoshita et al.
6,359,535 B1 3/2002 Takenoshita et al.
(Continued)

FOREIGN PATENT DOCUMENTS

CN 2798332 Y 7/2006
CN 2807498 Y 8/2006
(Continued)

OTHER PUBLICATIONS

International Search Report corresponding to PCT/JP2013/060876, mail date Jul. 9, 2013, 5 pages.
(Continued)

*Primary Examiner* — Benny Lee
(74) *Attorney, Agent, or Firm* — Wilmer Cutler Pickering Hale and Dorr LLP

(57) ABSTRACT

In order to prevent electrical characteristics from degrading, a band-pass filter includes: a dielectric substrate having an upper surface and a lower surface opposed to each other, the dielectric substrate extending in a waveguide axial direction; a pair of conductor layers respectively arranged on the upper surface and the lower surface of the dielectric substrate; two rows of through hole groups for sidewalls, which are formed at predetermined intervals in the waveguide axial direction so as to electrically connect the pair of conductor layers; and a plurality of through holes for electrically connecting the pair of conductor layers, the plurality of through holes being formed in parallel to the waveguide axial direction and arranged in a center of a waveguide formed in a region
(Continued)

surrounded by the pair of conductor layers and the two rows of the through hole groups for sidewalls.

6 Claims, 4 Drawing Sheets

(51) Int. Cl.
*H01P 3/12* (2006.01)
*H01P 1/207* (2006.01)

(58) Field of Classification Search
USPC ..... 333/208, 202, 219.1, 212
See application file for complete search history.

(56) References Cited

U.S. PATENT DOCUMENTS

| | | | | |
|---|---|---|---|---|
| 6,380,825 | B1 | 4/2002 | Takenoshita et al. | |
| 6,977,566 | B2 * | 12/2005 | Fukunaga | H01P 1/2088 333/208 |
| 2004/0251992 | A1 * | 12/2004 | Kim | H01P 3/122 333/208 |

FOREIGN PATENT DOCUMENTS

| | | | |
|---|---|---|---|
| CN | 201156573 | Y | 11/2008 |
| EP | 0898322 | A2 | 2/1999 |
| JP | 58-1301 | | 1/1983 |
| JP | 63-220603 | | 9/1988 |
| JP | 11-284409 | | 10/1999 |
| JP | 2011135151 | A | 7/2011 |

OTHER PUBLICATIONS

J. Bornemann and F. Taringou, "Substrate-Integrated Waveguide Filter Design Using Mode-Matching Techniques", Proceedings of the 41st European Microwave Conference, date of conference Oct. 10-13, 2011, Manchester, UK, pp. 1-4, abstract 1 page, total 5 pages.
Partial English Translation of Written Opinion corresponding to PCT/JP2013/060876, mail date Jul. 9, 2013, 6 pages.
Extended European Search Report issued in corresponding European Application No. 13800183.9, dated Jan. 20, 2016, 7 pages.
Jin Li et al. "Filter Design and Optimizing Based on a Neural Network", Electric Information and Control Engineering (ICEICE), 2011 International Conference on, IEEE, Apr. 15, 2011, pp. 1391-1394 (4 pages), XP031874829.
Chinese Office Action with Search Report issued in corresponding to Chinese Application No. 201380027919.3, dated Sep. 6, 2015, 8 pages.

* cited by examiner

BAND-PASS FILTER COMPRISED OF A DIELECTRIC SUBSTRATE HAVING A PAIR OF CONDUCTIVE LAYERS CONNECTED BY SIDEWALL THROUGH HOLES AND CENTER THROUGH HOLES

CROSS-REFERENCE TO RELATED APPLICATIONS

This application is a national stage application of International Application No. PCT/JP2013/060876 entitled "BAND-PASS FILTER" filed on Apr. 1, 2013, which claims priority to Japanese Application No. 2012-127061 filed Jun. 4, 2012, the disclosures of which are hereby incorporated by reference in their entirety.

TECHNICAL FIELD

This invention relates to a band-pass filter, in particular, a band-pass waveguide filter which is realized equivalently in a dielectric substrate.

BACKGROUND ART

Currently, in the development of high-frequency radio devices, the realization of low-loss connections for integration of various types of high-frequency circuits and the cost reduction and mass production of each element circuit are required. Therefore, the realization of the high frequency radio device within a small space while maintaining high-performance and high-functional characteristics is a key factor. In the high-frequency radio device, physical dimensions of a passive circuit such as a filter are substantially determined by a design frequency. Therefore, passive circuits such as filters have a low degree of freedom in flexible mounting components thereof.

A related band-pass filter is realized by sandwiching an E-plane parallel metal plate between rectangular waveguides obtained by dividing a rectangular waveguide in two at the middle of an H-plane to configure a single waveguide. In the case of the above-mentioned structure, the metal plate which is an element with high manufacturing accuracy and the rectangular waveguides which are subjected to cutting work are required. In terms of the connection to and the integration with planar circuits in a periphery, a mounting space is required.

Therefore, a technology of equivalently realizing a band-pass waveguide filter in a dielectric substrate has hitherto been proposed.

For example, in JP-A-11-284409 (Patent Document 1), there is disclosed a "waveguide band-pass filter" which has high productivity and can meet a requirement of size reduction. The waveguide band-pass filter disclosed in Patent Document 1 comprises a pair of main conductor layers sandwiching a dielectric substrate therebetween, and two rows of through conductor groups for sidewalls formed at intervals smaller than ½ of a signal wavelength in a signal transmission direction so as to electrically connect the main conductor layers. A plurality of through conductors, which electrically connect the main conductor layers to form inductive windows (inductive elements), are provided at intervals smaller than ½ of a wavelength in the waveguide in the signal transmission direction inside a dielectric waveguide line for transmitting a high-frequency signal through a region surrounded by the pair of main conductor layers and the two rows of through conductor groups for sidewalls.

In an example of one embodiment of Patent Document 1, as the plurality of through conductors, a maximum number (three in the embodiment) of through conductors are formed in an approximately middle portion of the dielectric waveguide line so as to be separated away from each other in a width direction. As the through conductors are separated away from the middle portion to both sides in the signal transmission direction, the number of the through conductors decreases.

PRIOR ART DOCUMENT

Patent Document

Patent Document 1: JP-A-11-284409

SUMMARY OF THE INVENTION

Problem to be Solved by the Invention

In the waveguide band-pass filter disclosed in Patent Document 1, the plurality of through conductors are formed in the approximately middle portion of the dielectric waveguide line so as to be separated away from each other in the width direction. Therefore, there is a problem in that electrical characteristics degrade when the positions of the through conductors vary in the width direction.

It is an object of this invention to provide a band-pass filter capable of preventing electrical characteristics from degrading.

Means to Solve the Problem

A band-pass filter according to this invention includes: a dielectric substrate having an upper surface and a lower surface opposed to each other, the dielectric substrate extending in a waveguide axial direction; a pair of conductor layers respectively arranged on the upper surface and the lower surface of the dielectric substrate; two rows of through hole groups for sidewalls, which are formed at predetermined intervals in the waveguide axial direction so as to electrically connect the pair of conductor layers; and a plurality of through holes for electrically connecting the pair of conductor layers, the plurality of through holes being formed in parallel to the waveguide axial direction and arranged in a center of a waveguide formed in a region surrounded by the pair of conductor layers and the two rows of the through hole groups for sidewalls.

Effect of the Invention

The band-pass filter according to this invention is capable of preventing electrical characteristics from degrading.

MODE FOR EMBODYING THE INVENTION

Related Art

Figure 1:
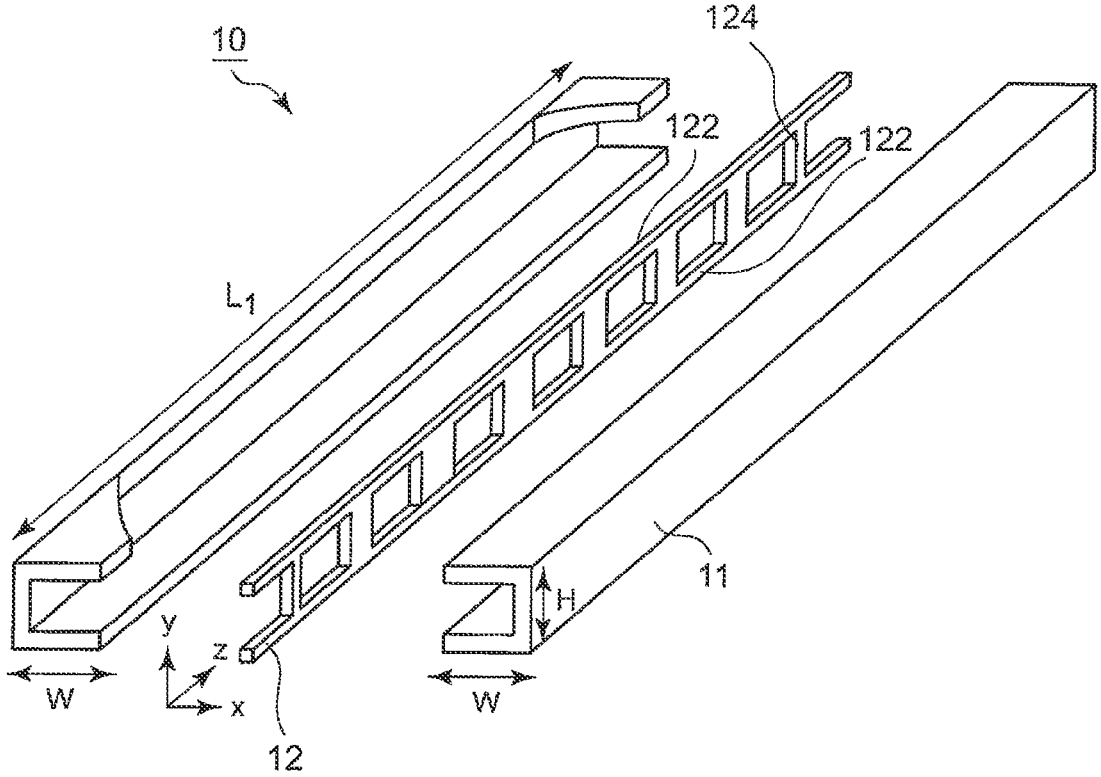
RELATED ART FIG. 1
FIG. 1 is a partially cutaway exploded perspective view illustrating a configuration of a related band-pass waveguide filter.

Referring to FIG. 1, a configuration of a related band-pass waveguide filter 10 is now described for easy understanding of this invention. FIG. 1 is a partially cutaway exploded perspective view illustrating the configuration of the related band-pass waveguide filter 10.

In the example of FIG. 1, an orthogonal coordinate system (x, y, z) has an x direction which extends laterally, a y direction which extends vertically, and a z direction which extends longitudinally. The x direction, the y direction, and the z direction are orthogonal to one another. The x direction is also referred to as a horizontal direction or a width direction. The y direction is also referred to as a vertical direction, a thickness direction, or a height direction. The z direction is also referred to as a longitudinal direction. A signal (electromagnetic wave) is transmitted (propagated) in the z direction. Therefore, the z direction is also referred to as a signal transmission direction (waveguide axial direction).

The band-pass waveguide filter 10 comprises rectangular waveguide sidewalls 11 obtained by dividing a rectangular waveguide into two in the middle of an H-plane, and an E-plane parallel metal plate 12. By sandwiching the E-plane parallel metal plate 12 between the rectangular waveguide sidewalls 11 obtained by the division, a single waveguide is configured. The E-plane parallel metal plate 12 determines a coupling coefficient required for the band-pass filter based on a shape of metal plates (such as a plate thickness or a width of a metal fin, and intervals between metal fins) arranged in a ladder-like pattern.

Each of the rectangular waveguide sidewalls 11 has a U-like cross section and has a width of 7.9 mm, a height (thickness) H of 7.9 mm, and a length $L_1$ of 124 mm.

The E-plane parallel metal plate 12 comprises two metal pieces 122 which are arranged in parallel so as to be separated away from each other in the vertical direction (y direction) and extend in the signal transmission direction (z direction), and a plurality of metal plates 124 arranged in a ladder-like pattern between the two metal pieces 122. The metal plates 124 are also referred to as metal fins. The metal fins 124 function as inductive elements. A shape of the metal fins 124 (such as a plate thickness, a width of the metal fin, and intervals between the metal fins) determines a coupling coefficient required for the band-pass filter.

Figure 2:
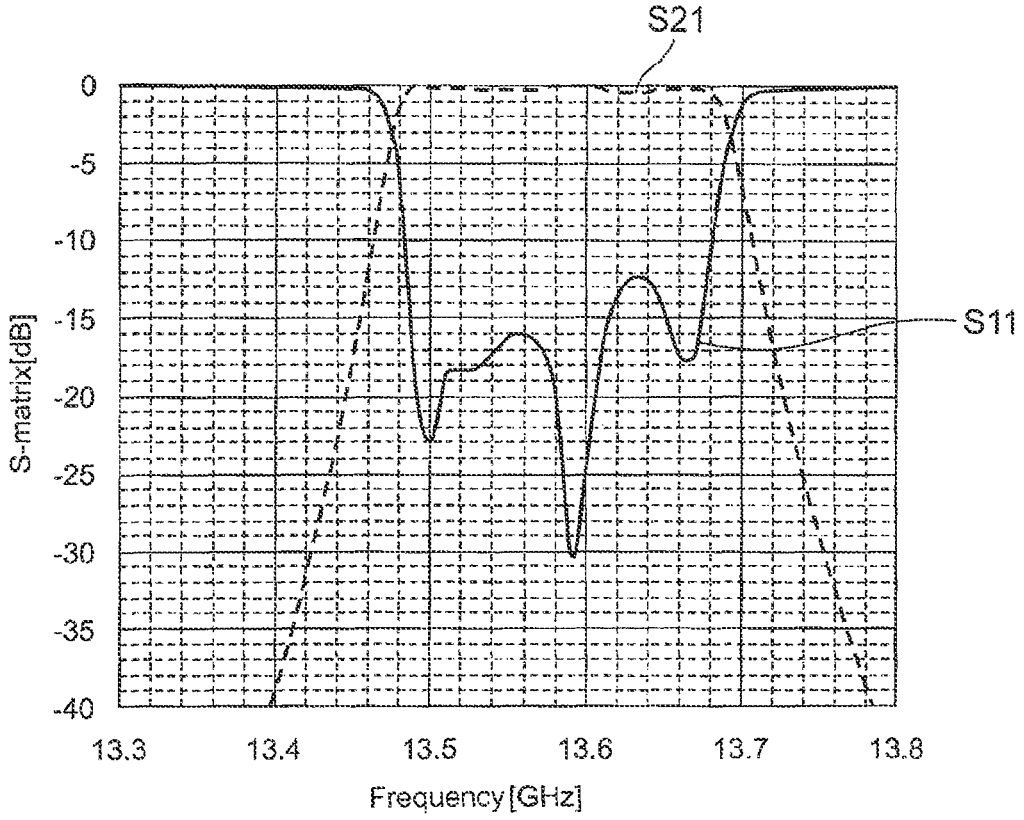
RELATED ART FIG. 2
FIG. 2 is a characteristic graph showing the results of analysis of frequency characteristics of S parameters of the related band-pass waveguide filter illustrated in FIG. 1 by an electromagnetic field simulation.

FIG. 2 is a characteristic graph showing the results of analysis of frequency characteristics of S parameters of the related band-pass waveguide filter 10 by an electromagnetic simulation. A horizontal axis of FIG. 2 represents a frequency [GHz], whereas a vertical axis represents S21 [dB] and S11 [dB] of the S parameters.

As well known in the field of art, as the S parameters, S21 corresponds to an insertion loss and S11 corresponds to a return loss. The insertion loss S21 is a loss of a signal (rower) passing through a terminal 2 (output terminal) when the signal is input to a terminal 1 (input terminal), which is expressed in dB (decibels). The return loss S11 is a loss of a signal (power) that is reflected and returned to the terminal 1 (input terminal) when the signal is input to the terminal 1 (input terminal), which is expressed in dB (decibels).

In the case of the structure of the related band-pass waveguide filter 10 illustrated in FIG. 1, the E-plane parallel metal plate 12 which is a mechanical component with high manufacturing accuracy and the pair of rectangular waveguide sidewalls 11 obtained by cutting work are required. In terms of the connection to and the integration with planar circuits in the periphery, a mounting space is required.

On the other hand, in the waveguide band-pass filter disclosed in Patent Document 1, the plurality of through conductors are formed in the approximately middle portion of the dielectric waveguide line so as to be separated away from each other in the width direction. Therefore, there is a problem in that electrical characteristics degrade when the positions of the through conductors vary in the width direction.

Exemplary Embodiment

A feature of this invention is now described.

This invention has a feature in that through holes are arranged in a dielectric substrate to form a waveguide and inductive coupling elements, thereby realizing a band-pass filter.

In this invention, metal-plated through holes are arranged as the waveguide sidewalls to form a waveguide. The metal fin portions are replaced by through holes. In this manner, a band-pass filter equivalent to that described above is configured.

Figure 3:
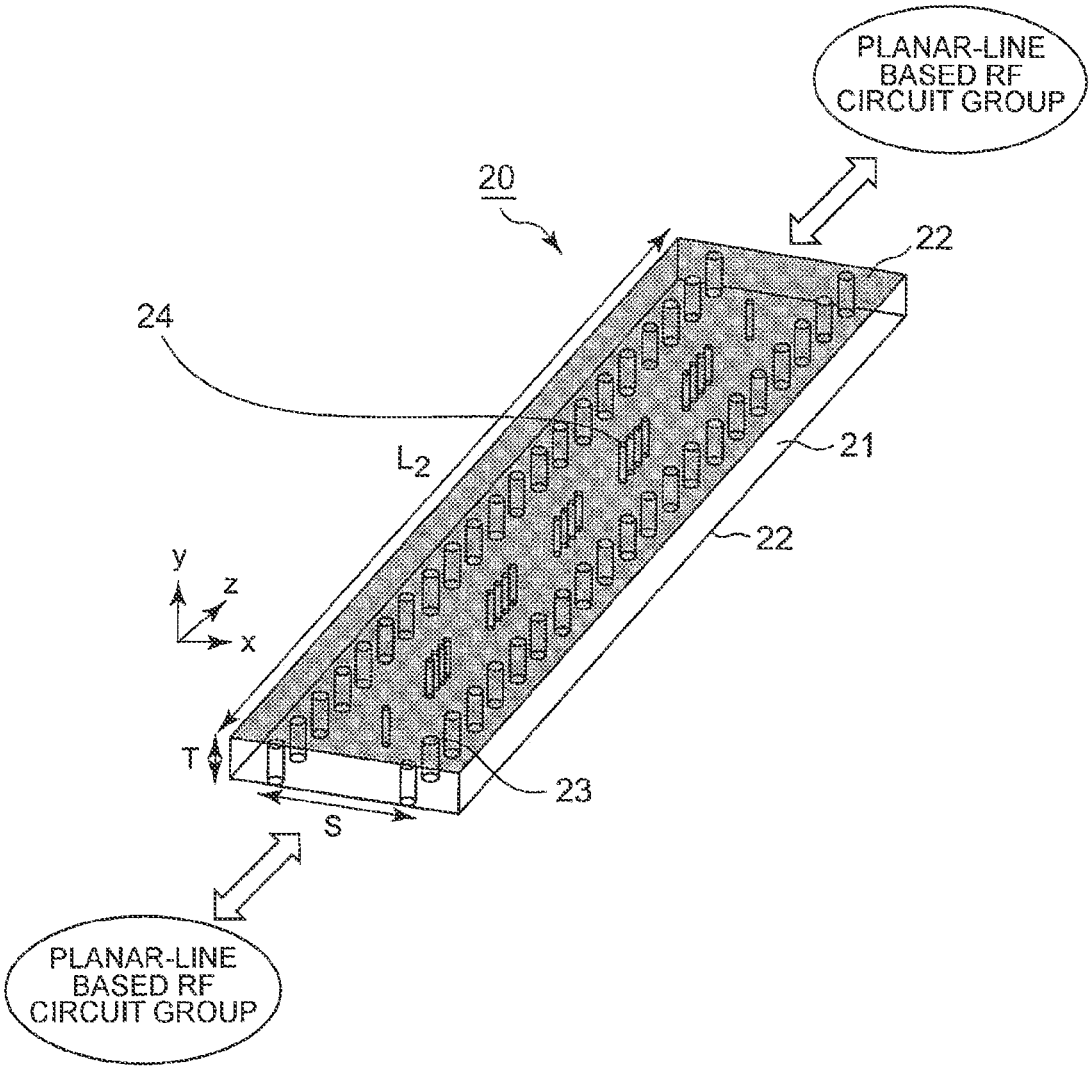
FIG. 3 is a perspective transparent view illustrating a structure of a band-pass filter according to a first example of this invention.

With the configuration described above, the filter can be realized in the dielectric substrate and is suitable for the connection to and the integration with planar-line based high-frequency circuits (RF circuits) in the periphery, as shown in FIG. 3. Moreover, mechanism elements which require high manufacturing accuracy such as the metal plate and the rectangular waveguide are unnecessary. Therefore, the band-pass filter is reduced in size by a relative permittivity and therefore is advantageous in view of the mounting space.

In other words, in this invention, the band-pass filter is realized by arranging the metal-plated through holes inside the dielectric substrate having the metal-bonded upper and lower surfaces. The band-pass filter can be manufactured by a conventional printed-board processing technology without requiring the mechanism elements. Moreover, the band-pass filter is reduced in size by a permittivity of the substrate, can be manufactured by the conventional printing technology, and is suitable for the connection to and integration with the planar circuits in the periphery in the same substrate.

In other words, this invention has a feature in that the E-plane band-pass waveguide filter using the mechanism elements such as the conventional metal plate and rectangular waveguide is configured by "replacement" with the metal-plated through holes.

From the point of view described above, an initial design is made with a closed waveguide requiring a small calculation load, and a final design can be determined in view of the Through holes. Therefore, it is easy to plan the design, providing excellent design performance.

The band-pass filter is configured only by arranging the through holes in a substrate thickness direction and therefore has a two-dimensional structure which is uniform in the thickness direction (y direction). Therefore, the band-pass filter is advantageous in terms of manufacture, analysis, and design.

The through holes located in the middle portion of the waveguide are arranged in parallel to the waveguide axis (z direction). As described above, the through holes for determining the coupling coefficient are arranged in the center of the waveguide. Therefore, the degradation of the electrical characteristics occurring when the positions of the through conductors vary in the width direction (x direction) as in the case of Patent Document 1 can be prevented. This is because an electromagnetic field in the waveguide has a peak value of a sine distribution in the vicinity of the center of the waveguide axis and is resistant to a manufacturing error.

First Example

FIG. 3 is a perspective transparent view illustrating a structure of a 13 GHz-band model band-pass filter 20 according to a first example of this invention.

In the example of FIG. 3, an orthogonal coordinate system (x, y, z) has an x direction which extends laterally, a y direction which extends vertically, and a z direction which extends longitudinally. The x direction, the y direction, and the z direction are orthogonal to one another. The x direction is also referred to as a horizontal direction or a width direction. The y direction is also referred to as a vertical direction or a thickness direction. The z direction is also referred to as a longitudinal direction. A signal (electromagnetic wave) is transmitted (propagated) in the z direction. Therefore, the z direction is also referred to as a signal transmission direction (waveguide axial direction).

The illustrated band-pass filter 20 is a design example with a design frequency of 13.6 GHz, a passband of 200 MHz, and an attenuation of 40 dB at ±200 MHz away from a center frequency, and has a six-stage configuration.

The band-pass filler 20 includes a dielectric substrate 21 having a cuboid shape with a thickness T of 1.6 mm and a length $L_2$ of 100 mm. The dielectric substrate 21 extends in the waveguide axial direction (z direction). Onto an upper surface and a lower surface of the dielectric substrate 21, each of a pair of conductor layers 22 made of a metal is bonded.

Two rows of metal-plated through holes 23 are arranged in the dielectric substrate 21 so as to be separated away from each other at a distance S of 10.8 mm in the width direction (x direction). The metal-plated through holes 23 electrically connect the pair of conductor layers 22 to each other. The metal-plated through holes 23 in each of the rows are arranged so as to extend in the waveguide axial direction (z direction) at intervals of about 0.3 wavelength or less and function as a sidewall. In the illustrated example, each of the rows of the metal-plated through holes 23 is formed by arranging through holes each having a diameter of 1.2 mm at intervals of 2.4 mm.

In a region surrounded by the pair of conductor layers 22 and the two rows of the meta plated through holes 23, a waveguide (22; 23) is configured (formed).

Therefore, a portion corresponding to the rectangular waveguide side-walls 11 illustrated in FIG. 1 corresponds to a portion of the metal-plated through holes 23 arranged on both sides illustrated in FIG. 3.

The metal-plated through holes 23 arranged on both sides are also referred to as through hole groups for sidewalls in two rows.

The band-pass filter 20 further comprises a plurality of through holes 24 arranged in the center (middle) of the waveguide (22; 23). The plurality of through holes 24 electrically connect the pair of conductor layers 22. The plurality of through holes 24 are arranged in the center of the waveguide (22; 23) in parallel to the waveguide axial direction (z direction).

Specifically, a portion of the metal fins 124 corresponding to the E-plane parallel metal plate 12 provided in the center of the H-plane of the waveguide illustrated in FIG. 1 is configured, in the band-pass filter 20 of FIG. 3, by the metal-plated through holes 24 arranged in the center of the waveguide (22; 23). In other words, a portion corresponding to the metal fins 124 (e.g., inductive elements) illustrated in FIG. 1 corresponds to a portion of the metal-plated through holes 24 arranged in the center in FIG. 3.

In the case of the band-pass waveguide filter 10 illustrated in FIG. 1, a coupling coefficient required for a desired band-pass filter is determined based on the shape of each of the metal fins 124 of the E-plane parallel metal plate 12, which are arranged in the ladder-like pattern.

On the other hand, in the band-pass filter 20 illustrated in FIG. 3, a coupling coefficient required for a desired band-pass filter is determined based on the number, a radius, and positions of the metal-plated through holes 24 arranged in the middle of the H-plane of the waveguide. In this case, in order to achieve an appropriate coupling coefficient, a diameter of each of the through holes 24 is set to 0.6 mm. This structure can be realized by a printing technology and is suitable for the integration with planar circuits in the periphery in the same substrate 21.

In the illustrated example, the number of metal-plated through holes 24 arranged in the middle is five groups of four through holes and two individual through holes, that is, twenty two in total. Specifically, as the metal-plated through holes 24 arranged in the middle, the individual through holes and the groups of four through holes are arranged at intervals. However, the number and the position of arrangement of the through holes 24 are not limited to those described above and variously changed depending on the design frequency.

Next, operation and effects of the band-pass filter 20 illustrated in FIG. 3 are described.

The metal-plated through holes 23 arranged at about 0.3 wavelength or less in the direction parallel to the E-plane (y direction) have a small leakage loss of power between the through holes 23 and therefore operate in the dielectric substrate 21 equivalently as metal walls.

Thus, by arranging the metal-plated through holes 23 at appropriate positions, the conventional metal wall portions of the band-pass waveguide filter 10 including the E-plane parallel metal plate 12 can be replaced by the metal-plated through holes 23.

According to this example, the band-pass filter 20 can be configured by the conventional printing technology of arranging the metal-plated through holes 23 and 24 in the dielectric substrate 21 having the upper and lower surfaces onto which the conductor layers 22 (e.g., metals) are bonded, without using three-dimensional mechanism elements such as the rectangular waveguide which is subjected to cutting work and the E-plane parallel metal plate. The band-pass filter can be realized in the dielectric substrate 21 and therefore is suitable for the integration with planar-line based high-frequency circuits in the periphery in the same substrate 21.

Moreover, this structure is uniform in the thickness direction (y direction) and therefore can be realized with the dielectric substrate 21 having any thickness. Thus, excellent design performance is provided.

The band-pass filter is configured in the dielectric substrate 21 and is therefore reduced in size in proportion to the reciprocal of the square root of the relative permittivity of the dielectric substrate 21, thus providing advantages even in view of the mounting space. For example, when a Teflon (trademark for polytetrafluoroethylene) substrate (having a relative permittivity of 2.2) is used as the dielectric substrate 21, the dimensions are reduced from 15.8 mm to 10.8 mm in the width direction (x direction) and from 124 mm to 100 mm in the waveguide axial direction (z direction) in the case of the 13 GHz-band model.

Figure 4:
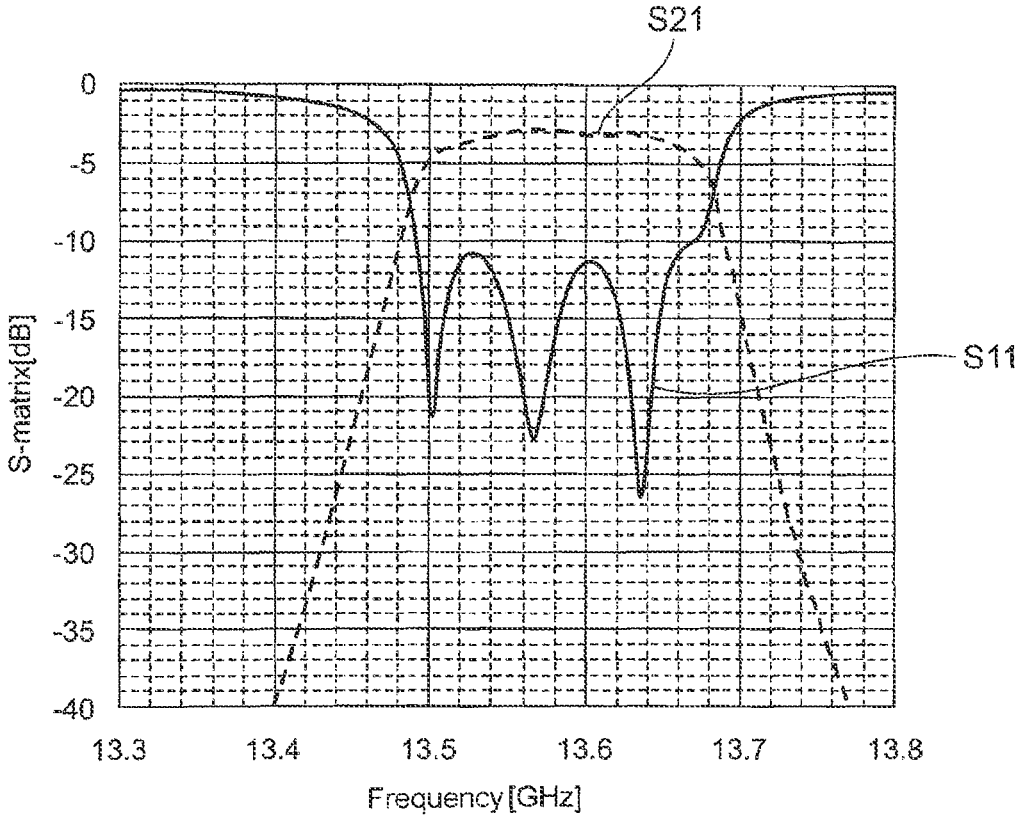
FIG. 4 is a characteristic graph showing the results of analysis of frequency characteristics of S parameters of the band-pass filter illustrated in FIG. 3 by an electromagnetic field simulation.

As an example, FIG. 4 shows the results of analysis of frequency characteristics of parameters of the 13 GHz-band model band-pass filter 20 by an electromagnetic simulation. In FIG. 4, a horizontal axis represents a frequency [GHz], whereas a vertical axis represents S21 [dB] and S11 [dB] of the S parameters.

When a Teflon substrate (having the relative permittivity of 2.2 and tan $\delta$=0.00085) is used as the dielectric substrate 21, a passband of about 200 MHz and an attenuation of about 40 dB at 200 MHz away are realized.

As is apparent from the comparison with FIG. 2, characteristics substantially equivalent to those of the related band-pass waveguide filter 10 (FIG. 1) are realized as attenuation characteristics except for the insertion loss S21 in a passband. The insertion loss S21 increases to about 3.0 dB as compared with that of the related band-pass waveguide filter 10. The increase is principally attributed to a dielectric loss and is highly expected to be improved by selecting a material having small tan $\delta$.

Next, effects of the first example of this invention will be described.

The effects of the first example are to prevent the degradation of the electrical characteristics. This is because the metal-plated through holes 24 are arranged in the center of the waveguide in parallel to the waveguide axial direction (z direction).

While the invention has been particularly shown and described with reference to an example thereof, the invention is not limited to this example. It will be understood by those of ordinary skill in the art that various changes in form and details may be made therein without departing from the spirit and scope of the invention as defined by the claims.

INDUSTRIAL APPLICABILITY

This invention can be used for an RF transmission/reception separating circuit included in an input section of a simplified radio device for the purpose of constructing a low-cost flexible backbone network system.

REFERENCE SIGNS LIST

20—band-pass filter
21—dielectric substrate
22—conductor layer
23—metal-plated through holes arranged on bath sides (through hole group for sidewall)
24—metal-plated through hole arranged in center This application is based upon and claims the benefit of priority from Japanese Patent Application No. 2012-127061, filed on Jun. 4, 2012, the disclosure of which is incorporated herein in its entirety by reference.

The invention claimed is:

1. A band-pass filter, comprising:

a single dielectric substrate comprising a single dielectric layer having an upper surface and a lower surface opposed to each other, the single dielectric substrate having a cuboid shape extending in a waveguide axial direction;

a pair of conductor layers respectively arranged on the upper surface and the lower surface of the dielectric substrate;

two rows of through hole groups for forming sidewalls, which are formed at predetermined intervals in the waveguide axial direction so as to electrically connect the pair of conductor layers, the two rows of through hole groups for forming sidewalls being arranged in the single dielectric substrate so as to be separated away from each other at a fixed distance in a width direction orthogonal to the waveguide axial direction, each row of through hole groups for forming sidewalls being linearly arranged in a single straight line that is in parallel with the waveguide axial direction; and a plurality of center through holes for electrically connecting the pair of conductor layers, the plurality of center through holes being formed in parallel to the waveguide axial direction and arranged in a center of a waveguide formed in a region surrounded by the pair of conductor layers and the two rows of the through hole groups for forming sidewalls.

2. The band-pass filter according to claim 1, wherein each of the predetermined intervals is about 0.3 wavelength or less.

3. The band-pass filter according to claim 2, wherein each of the through hole groups for forming sidewalls in the two rows has a diameter of 1.2 mm, and each of the predetermined intervals is 2.4 mm.

4. The band-pass filter according to claim 3, wherein the single dielectric substrate comprises end portions in the waveguide axial direction and a middle portion between the end portions, and wherein the plurality of center through holes comprise one through hole formed in each of the end portions and groups of a plurality of through holes arranged at intervals in the middle portion.

5. The band-pass filter according to claim 4, wherein a number of the plurality of through holes included in each of the groups is four.

6. The band-pass filter according to claim 3, wherein each of the plurality of center through holes has a diameter of 0.6 mm.

* * * * *